US009552942B2

(12) United States Patent
Yamashita et al.

(10) Patent No.: US 9,552,942 B2
(45) Date of Patent: Jan. 24, 2017

(54) GAS CIRCUIT BREAKER

(75) Inventors: Toru Yamashita, Chiyoda-ku (JP); Daisuke Yoshida, Chiyoda-ku (JP); Hirokazu Otani, Chiyoda-ku (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 271 days.

(21) Appl. No.: 14/361,901

(22) PCT Filed: Mar. 16, 2012

(86) PCT No.: PCT/JP2012/056890

§ 371 (c)(1),
(2), (4) Date: May 30, 2014

(87) PCT Pub. No.: WO2013/136516

PCT Pub. Date: Sep. 19, 2013

(65) Prior Publication Data

US 2014/0299578 A1 Oct. 9, 2014

(51) Int. Cl.
*H01H 33/04* (2006.01)
*H01H 33/70* (2006.01)

(52) U.S. Cl.
CPC ..... *H01H 33/04* (2013.01); *H01H 33/7084* (2013.01); *H01H 33/7092* (2013.01)

(58) Field of Classification Search
CPC ..... H01H 33/04; H01H 33/52; H01H 33/14; H01H 33/70; H01H 33/7084; H01H 33/7092; H01H 33/7015; H01H 33/7061; H01H 33/66261

(Continued)

(56) References Cited

U.S. PATENT DOCUMENTS 5,902,978 A 5/1999 Zehnder et al.
5,929,409 A 7/1999 Zehnder et al.

(Continued)

FOREIGN PATENT DOCUMENTS

JP 56-143627 A 11/1981
JP 10-031944 A 2/1998

(Continued)

OTHER PUBLICATIONS

International Search Report (PCT/ISA/210) mailed on Apr. 10, 2012, by the Japanese Patent Office as the International Searching Authority for International Application No. PCT/JP2012/056890.

(Continued)

*Primary Examiner* — Renee Luebke
*Assistant Examiner* — William Bolton
(74) *Attorney, Agent, or Firm* — Buchanan Ingersoll & Rooney PC

(57) ABSTRACT

A gas circuit breaker includes contact rings formed of an elastically deformable material, a movable contact that moves reciprocally along an axis line direction between a current supply position where the movable contact bridges the contact rings and a current cutoff position where the movable contact is separated from both the contact rings, holding tools formed in an annular shape and respectively attached to the contact rings, a covering member having electrically insulating property, slidably attached to a distal end portion of the holding tool in the axis line direction, and configured to be brought into contact with the contact ring, and a covering member having electrically insulating property, slidably attached to a distal end portion of the holding tool in the axis line direction, and configured to be brought into contact with the contact ring.

8 Claims, 10 Drawing Sheets

(58) Field of Classification Search
USPC ..... 218/13, 43, 48–51, 16, 18, 55–57, 59,218/67–68
See application file for complete search history.

(56) References Cited

U.S. PATENT DOCUMENTS

| | | | | |
|---|---|---|---|---|
| 6,100,492 | A | 8/2000 | Zehnder et al. | |
| 6,740,837 | B2 * | 5/2004 | Zehnder | H01H 33/7069 218/43 |
| 9,012,800 | B2 * | 4/2015 | Yamashita | H01H 33/7015 218/11 |
| 2002/0060203 | A1 | 5/2002 | Zehnder et al. | |
| 2012/0261385 | A1 | 10/2012 | Yamashita et al. | |

FOREIGN PATENT DOCUMENTS

| | | | |
|---|---|---|---|
| JP | 10-031945 | A | 2/1998 |
| JP | 11-329176 | A | 11/1999 |
| JP | 2002-203463 | A | 7/2002 |
| JP | 2010-244717 | A | 10/2010 |
| JP | 2010-282802 | A | 12/2010 |
| JP | 4684373 | B1 | 5/2011 |
| JP | 2011-238493 | A | 11/2011 |
| WO | WO 2011/096097 | A1 | 8/2011 |

OTHER PUBLICATIONS

Written Opinion (PCT/ISA/237) mailed on Apr. 10, 2012, by the Japanese Patent Office as the International Searching Authority for International Application No. PCT/JP2012/056890.

* cited by examiner

GAS CIRCUIT BREAKER

FIELD

The present invention relates to a gas circuit breaker, and more particularly to a gas circuit breaker for supplying or cutting off a current in a power plant, a substation, or the like.

BACKGROUND

A conventional gas circuit breaker is disclosed in, for example, Patent Literature 1 (see FIG. 3). This gas circuit breaker is incorporated in a housing filled with insulation gas, and configured rotationally symmetrically around a central axis line. A pair of holding members is arranged around the central axis line, which holds a pair of contact rings (fixed contacts) formed of a wear-resistant metal material. The pair of contact rings is formed in a funnel shape with respect to the central axis line, arranged at a predetermined interval in the central axis line direction in a manner that a diameter is decreased toward a direction in which the contact rings approach to each other. The pair of contact rings is formed of, for example, an elastically deformable member in which a plurality of slits is formed in a radial fashion with respect to the central axis line. A pair of holding tools is attached to side surfaces of the pair of contact rings facing each other. A pair of first covering members is attached and fixed to distal ends of the pair of holding tools by a pair of second covering members. A movable contact moves reciprocally in the center axis direction between a state where the pair of contact rings is brought into contact with an outer diameter surface of the movable contact (a current supply position) and a state where the pair of contact rings is separated from the movable contact (a current cutoff position).

In this conventional gas circuit breaker, at the time of cutting off a current, arc is generated between the pair of contact rings, and gas heated by the arc flows from the inside of an arc discharge space in a contact area into an annular heating chamber outside the contact area toward an outer side in the radial direction. When the arc is extinguished, pressurized gas accumulated in the heating chamber flows into the arc discharge space toward an inner side in the radial direction that is a direction opposite to the outer side in the radial direction, and further flows out to an exhaust chamber from the arc discharge space.

CITATION LIST

Patent Literature

Patent Literature 1: Japanese Patent No. 4684373

SUMMARY

Technical Problem

Although the gas heated by the arc at the time of cutting off a current flows into the heating chamber, there is a gap between each of the contact rings and the holding tool held by each of the contact rings and each of the contact rings includes slits, and hence the gas leaks out to the exhaust chamber through the gap and the slits. Furthermore, when the arc is extinguished, although the gas accumulated in the heating chamber flows to the arc discharge space, some of the gas also flows to the exhaust chamber directly through the gap and the slits.

That is, in the conventional gas circuit breaker, there is a problem in that when a large amount of gas flows out to the gap and the slits, the pressure rise in the heating chamber becomes insufficient, and gas flowing into the arc discharge space at the time when the arc is extinguished is decreased.

The present invention has been achieved in view of the above problems, and an object of the present invention is to provide a gas circuit breaker that enables high-temperature gas generated in an arc discharge space to be effectively introduced into a heating chamber and arc-extinguishing gas to be effectively sprayed to the arc at the time of extinguishing the arc.

Solution to Problem

In order to solve above-mentioned problems and to achieve an object of the present invention, there is provided a gas circuit breaker according to the present invention, the gas circuit breaker including a first fixed contact and a second fixed contact arranged facing each other at a predetermined interval in an axis line direction, each of the first and second fixed contacts being formed of an elastically deformable material in an annular shape around an axis line, a movable contact inserted into the first and second fixed contacts and reciprocally movable along the axis line direction between a current supply position where the movable contact bridges the first fixed contact and the second fixed contact and a current cutoff position where the movable contact is separated from both the first and second fixed contacts, a first holding tool formed in an annular shape and attached to a surface of the first fixed contact on a side of the second fixed contact, a second holding tool formed in an annular shape and attached to a surface of the second fixed contact on a side of the first fixed contact, a first covering member having electrically insulating property, slidably attached to a distal end portion of the first holding tool in the axis line direction, and configured to cover at least an inner diameter side of the distal end portion and to be brought into contact with the first fixed contact in a state of being arranged nearest to the side of the first fixed contact, and a second covering member having electrically insulating property, slidably attached to a distal end portion of the second holding tool in the axis line direction, and configured to cover at least an inner diameter side of the distal end portion and to be brought into contact with the second fixed contact in a state of being arranged nearest to the side of the second fixed contact.

Advantageous Effects of Invention

According to the present invention, because the first and second covering members are movable in the axis line direction, when cutting off a current, the first and second covering members can be moved to positions where the first and second covering members are brought into contact with the first and second fixed contacts, respectively, to eliminate the gap, and hence high-temperature gas in the arc discharge space between the first and second fixed contacts can be effectively introduced into the heating chamber formed on the outer diameter side of the first and second holding tools, and when the arc is extinguished, the arc-extinguishing gas can be effectively sprayed to the arc.

DESCRIPTION OF EMBODIMENTS

Exemplary embodiments of a gas circuit breaker according to the present invention will be explained below in detail with reference to the accompanying drawings. The present invention is not limited to the following embodiments.

First Embodiment

Figure 1:
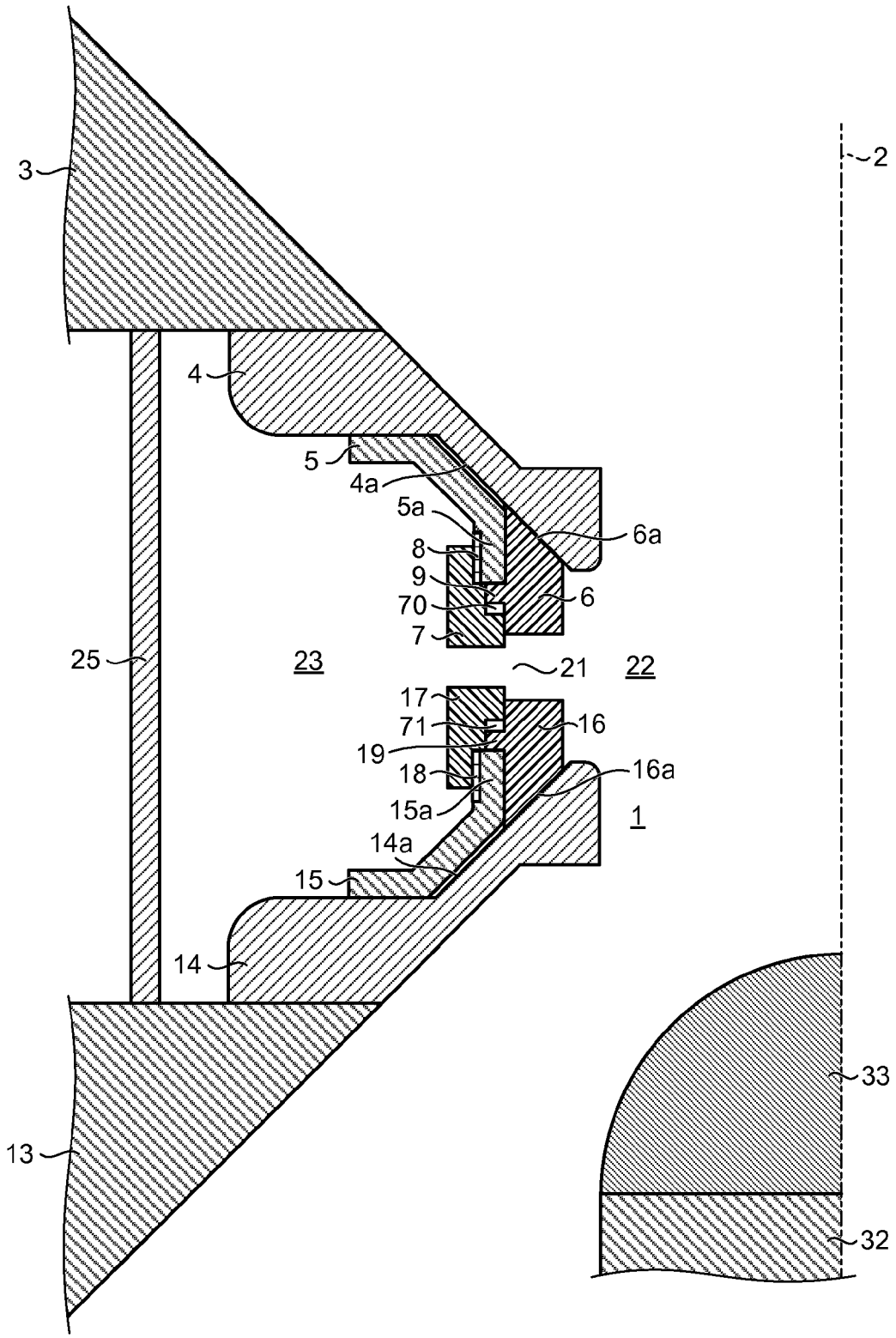
FIG. 1 is a cross-sectional view of a configuration of an arc-extinguishing chamber of a gas circuit breaker according to a first embodiment, depicting an arrangement configuration at the time of cutting off a current.
Figure 2:
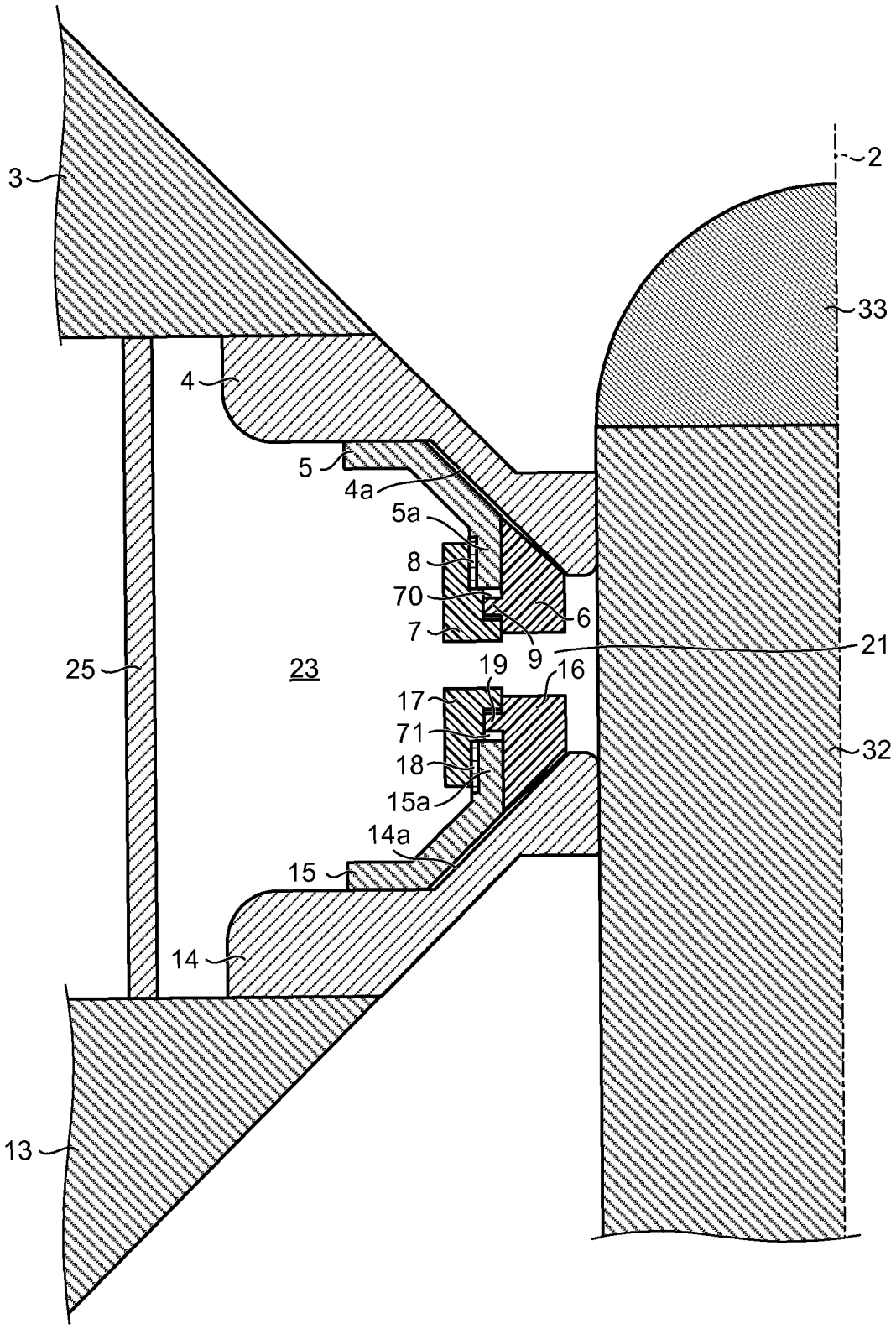
FIG. 2 is cross-sectional view of the configuration of the arc-extinguishing chamber of the gas circuit breaker according to the first embodiment, depicting an arrangement configuration at the time of supplying a current.
Figure 3:
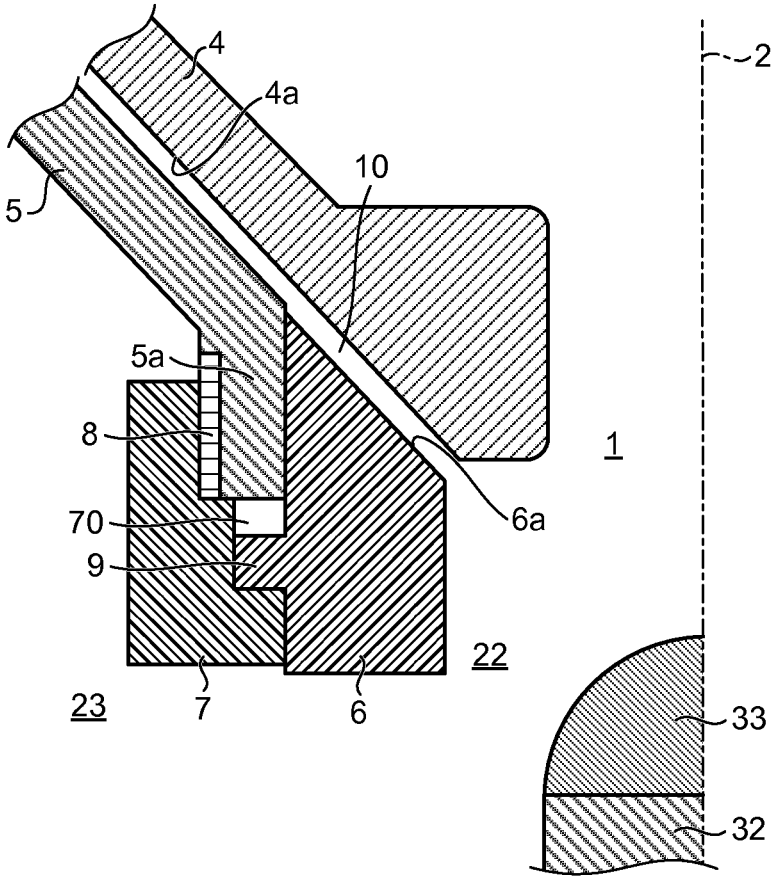
FIG. 3 is a cross-sectional view of a portion of relevant parts of an arc-extinguishing chamber in the middle of current cutoff according to the first embodiment.
Figure 4:
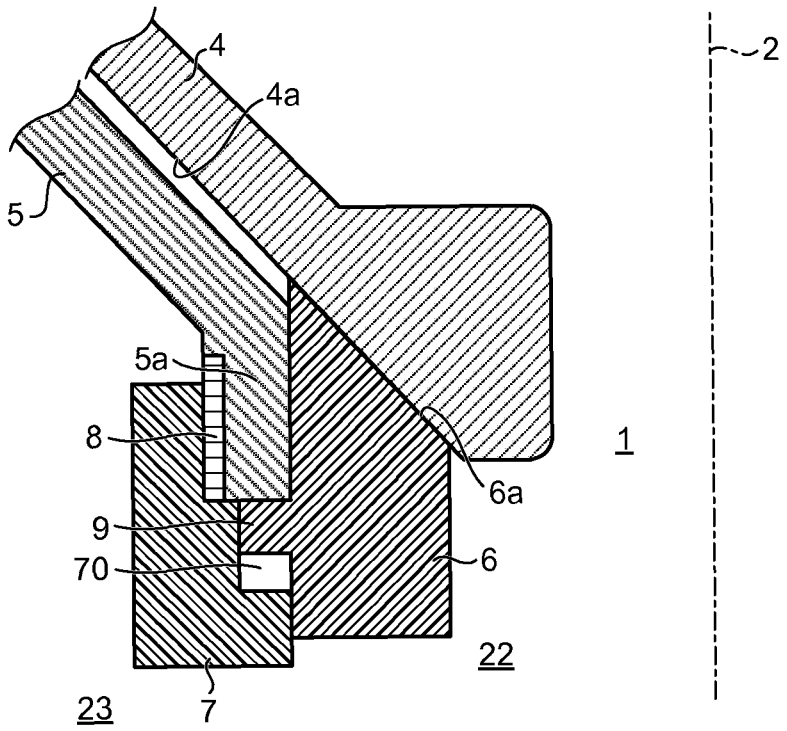
FIG. 4 is a diagram corresponding to FIG. 3 in a current cutoff state.
Figure 5:
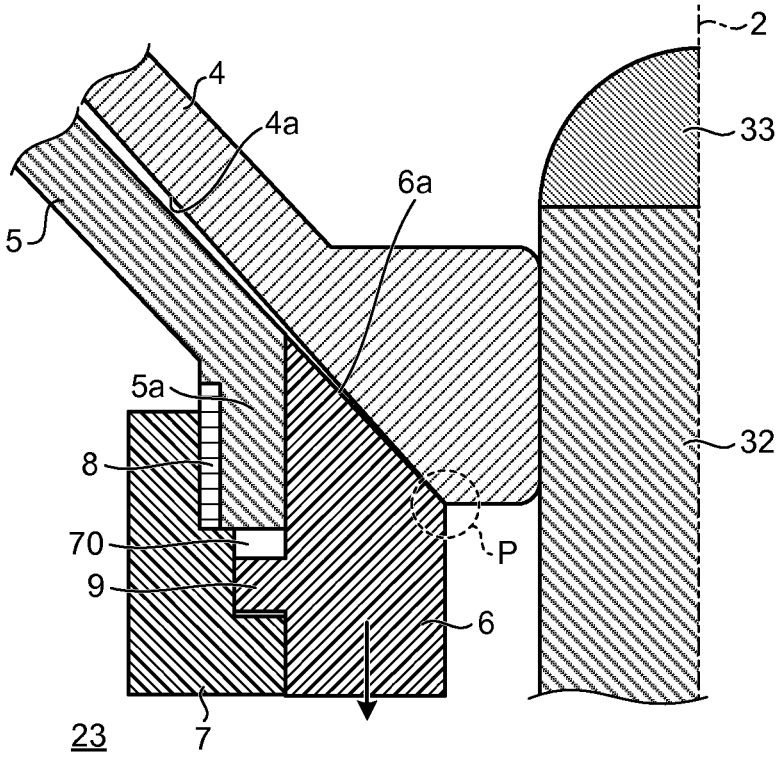
FIG. 5 is a diagram corresponding to FIG. 3 in a current supply state.

FIG. 1 is a cross-sectional view of a configuration of an arc-extinguishing chamber of a gas circuit breaker according to a first embodiment of the present invention, depicting an arrangement configuration at the time of cutting off a current. FIG. 2 is cross-sectional view of a configuration of the arc-extinguishing chamber of the gas circuit breaker according to the present embodiment, depicting an arrangement configuration at the time of supplying a current. FIG. 3 is a cross-sectional view of a portion of relevant parts of the arc-extinguishing chamber in the middle of current cutoff. FIG. 4 is a diagram corresponding to FIG. 3 in a current cutoff state, and FIG. 5 is a diagram corresponding to FIG. 3 in a current supply state.

An overall configuration of an arc-extinguishing chamber of a gas circuit breaker is explained first with reference to FIGS. 1 and 2. In FIGS. 1 and 2, the gas circuit breaker is incorporated in a housing (not shown) that constitutes the arc-extinguishing chamber filled with insulation gas (arc-extinguishing gas). This gas circuit breaker is configured rotationally symmetrically around a central axis line 2. In FIGS. 1 and 2, only a half of the cross-sectional configuration is shown with respect to the central axis line 2.

A pair of holding members 3 and 13 is arranged around the central axis line 2. The holding members 3 and 13 are formed in an annular shape, and are arranged at a predetermined interval in a direction along the central axis line 2 (hereinafter, "axis line direction"). A partition 25 is arranged to surround the central axis line 2 between the holding members 3 and 13.

The holding member 3 holds a contact ring 4 (first fixed contact) on a surface of a side facing the holding member 13. The holding member 13 holds a contact ring 14 (second fixed contact) on a surface of a side facing the holding member 3. The contact rings 4 and 14, which are fixed contacts, are formed of a wear-resistant metal material. Each of the contact rings 4 and 14 is formed in, for example, a funnel shape with respect to the central axis line 2 with a diameter decreasing toward a direction in which the contact rings 4 and 14 approach each other. The contact rings 4 and 14 are arranged at a predetermined interval in the axis line direction. A plurality of slits is formed on each of the contact rings 4 and 14 in a radial fashion with respect to the central axis line 2. An outer diameter of a movable contact 32 is larger than an inner diameter of each of the contact rings 4 and 14. Each of the contact rings 4 and 14 is formed of an elastically deformable member, and is elastically deformed when being brought into contact with or separated from the movable contact 32. That is, each of the contact rings 4 and 14 includes a plurality of elastic contact fingers.

The movable contact 32 is movable in a reciprocating manner in the axis line direction by a driving device (not shown). The movable contact 32 is formed in a shaft shape with its central axis line matching, for example, the central axis line 2. The movable contact 32 includes an apical portion 33 formed of a burnout-resistant material. The movable contact 32 is movable in the axis line direction between a current supply position where the contact rings 4 and 14 are brought into contact with an outer surface of the movable contact 32 and a current cutoff position where the contact rings 4 and 14 are separated from the movable contact 32. At the current supply position, the contact rings 4 and 14 are in a state of being bridged by the movable contact 32.

The contact ring 4 includes an inclined surface 4*a*. The inclined surface 4*a* is a portion of a surface of the contact ring 4, facing the contact ring 14 and inclined with respect to the axis line direction. The contact ring 14 includes an inclined surface 14*a*. The inclined surface 14*a* is a portion of a surface of the contact ring 14, facing the contact ring 4 and inclined with respect to the axis line direction. The inclined surfaces 4*a* and 14*a* define outer surfaces of the funnel shapes of the contact rings 4 and 14, respectively.

A holding tool 5 (first holding tool) made of, for example, metal is attached on a side of the inclined surface 4*a* on the contact ring 4. A holding tool 15 (second holding tool) made of, for example, metal is attached on a side of the inclined surface 14*a* on the contact ring 14. The holding tool 5 includes a fixed end that is fixed to the contact ring 4, a portion arranged along the inclined surface 4*a*, and a distal end portion 5*a* that is bent along the axis line direction and extends toward the contact ring 14. The holding tool 15 includes a fixed end that is fixed to the contact ring 14, a portion arranged along the inclined surface 14*a*, and a distal end portion 15*a* that is bent along the axis line direction and extends toward the contact ring 4. Each of the holding tools 5 and 15 is formed in an annular shape. A gap is provided between the inclined surface 4*a* of the contact ring 4 and the holding tool 5 to allow displacement of the contact ring 4 at the time when the contact ring 4 is elastically deformed. A gap is provided between the inclined surface 14*a* of the contact ring 14 and the holding tool 15 to allow displacement of the contact ring 14 at the time when the contact ring 14 is elastically deformed.

Covering members 6 and 7 are attached to the distal end portion 5*a* of the holding tool 5. Each of the covering members 6 and 7 is formed in an annular shape, and the covering member 6 is arranged closer to the inner diameter side than the covering member 7. The covering member 6 (first covering member) includes a tapered portion on a side of the contact ring 4, and this tapered portion includes an inclined surface 6*a* which is parallel to the inclined surface 4*a*. A screw portion 8 is formed on an outer diameter surface of the distal end portion 5*a* of the holding tool 5. A screw portion (not shown) is formed on an inner diameter surface of the covering member 7 (third covering member), and this screw portion is engaged with the screw portion 8 provided on the distal end portion 5*a*, by which the covering member 7 is attached and fixed to the distal end portion 5*a* of the holding tool 5. The covering member 7 can be fixed to the holding tool 5 by other methods. The covering members 6 and 7 are attached to the holding tool 5 to cover the distal end portion 5*a*. Each of the covering members 6 and 7 is an insulating member formed of an electrically insulating material.

Covering members 16 and 17 are attached to the distal end portion 15*a* of the holding tool 15. Each of the covering members 16 and 17 is formed in an annular shape, and the covering member 16 (second covering member) is arranged closer to the inner diameter side than the covering member 17 (fourth covering member). The covering member 16 includes a tapered portion on a side of the contact ring 14, and this tapered portion includes an inclined surface 16*a* which is parallel to the inclined surface 14*a*. A screw portion 18 is formed on an outer diameter surface of the distal end portion 15*a* of the holding tool 15. A screw portion (not shown) is provided on an inner diameter surface of the covering member 17, and this screw portion is engaged with the screw portion 18 provided on the distal end portion 15*a*, by which the covering member 17 is attached and fixed to the distal end portion 15*a* of the holding tool 15. The covering member 17 can be fixed to the holding tool 15 by other methods. The covering members 16 and 17 are attached to the holding tool 15 to cover the distal end portion 15*a*. Each of the covering members 16 and 17 is an insulating member formed of an electrically insulating material.

A gap 21 formed in an annular shape around the central axis line 2 is provided between the covering members 6 and 7 and the covering members 16 and 17. The gap 21 defines a thermal puffer spray port. A contact area 1 where the arc-extinguishing gas and the arc are brought into contact with each other is formed in a space on the inner side in the radial direction surrounded by the contact rings 4 and 14. The contact area 1 is formed rotationally symmetrically around the central axis line 2. An arc discharge space 22 is formed in the contact area 1 between the contact rings 4 and 14. Furthermore, a heating chamber 23 surrounded by the holding tools 5 and 15, the covering members 7 and 17, and the partition 25 is formed outside the contact area 1.

An arrangement configuration of relevant parts of an arc-extinguishing chamber is explained with reference to FIGS. 1 to 5. Although the contact ring 4, the holding tool 5, and the covering members 6 and 7 are shown in FIGS. 3 to 5, a similar configuration is established for the contact ring 14, the holding tool 15, and the covering members 16 and 17. Further, in FIGS. 3 to 5, the contact ring 4, the holding tool 5, and the covering members 6 and 7 are shown larger than those shown in FIGS. 1 and 2, while the movable contact 32 is shown smaller in order to exhibit a positional relationship between the components. However, in FIG. 4, an illustration of the movable contact 32 is omitted because it is located below in the drawing.

Protrusions 9 and 19 are formed on the covering members 6 and 16, respectively. The protrusions 9 and 19 are formed on outer diameter surfaces of the covering members 6 and 16, respectively, protruding in the radial direction. The protrusions 9 and 19 are provided across a circumferential direction, for example.

In a state where the covering member 7 is attached to the holding tool 5, a recessed portion 70 that is opened toward the central axis line 2 is formed by a portion of an end surface of the distal end portion 5*a* of the holding tool 5 and a portion of the inner diameter surface of the covering member 7 that is formed in a stepwise shape. The protrusion 9 is arranged in the recessed portion 70 that is formed by the distal end portion 5*a* and the covering member 7. The length of the recessed portion 70 in the axis line direction is longer than the length of the protrusion 9 in the axis line direction, and hence the covering member 6 is arranged in a movable manner in the axis line direction. That is, a space (gap) is formed in the recessed portion 70 in a manner that the covering member 6 is movable in the axis line direction in a state where the protrusion 9 is inserted in the recessed portion 70. It is also possible to provide the recessed portion 70 only on the covering member 7. The covering member 6 is attached to the covering member 7 and the holding tool 5 in a manner that the outer diameter surface of the covering member 6 is slidable along the inner diameter surface of the covering member 7 and the inner diameter surface of the distal end portion 5*a*. A slidable range of the covering member 6 in the axis line direction is limited by the covering member 7. In this manner, the covering member 6 is attached to the distal end portion 5*a* of the holding tool 5.

In a state where the covering member 17 is attached to the holding tool 15, a recessed portion 71 that is opened toward the central axis line 2 is formed by a portion of an end surface of the distal end portion 15*a* of the holding tool 15 and a portion of the inner diameter surface of the covering member 17 that is formed in a stepwise shape. The protrusion 19 is arranged in the recessed portion 71 that is formed by the distal end portion 15*a* and the covering member 17. The length of the recessed portion 71 in the axis line direction is longer than the length of the protrusion 19 in the axis line direction, and hence the covering member 16 is arranged in a movable manner in the axis line direction. That is, a space (gap) is formed in the recessed portion 71 in a manner that the covering member 16 is movable in the axis line direction in a state where the protrusion 19 is inserted in the recessed portion 71. It is also possible to provide the recessed portion 71 only on the covering member 17. The covering member 16 is attached to the covering member 17 and the holding tool 15 in a manner that the outer diameter surface of the covering member 16 is slidable along the inner diameter surface of the covering member 17 and the inner diameter surface of the distal end portion 15*a*. A slidable range of the covering member 16 in the axis line direction is limited by the covering member 17. In this manner, the covering member 16 is attached to the distal end portion 15*a* of the holding tool 15.

A position where a side surface of the protrusion 9, which is on the opposite side of the distal end portion 5*a*, is brought into contact with the covering member 7 is in a state where the covering member 6 is arranged nearest to a side of the contact ring 14 in the axis line direction, and at this position, a gap 10 is formed between the inclined surface 6*a* of the covering member 6 and the inclined surface 4*a* of the contact ring 4 (see FIG. 3). Similarly, although it is not shown in FIG. 3, a position where a side surface of the protrusion 19, which is on the opposite side of the distal end portion 15*a*, is brought into contact with the covering member 17 is in a state where the covering member 16 is arranged nearest to a side of the contact ring 4 in the axis line direction, and at this position, a gap is formed between the inclined surface 16*a* of the covering member 16 and the inclined surface 14*a* of the contact ring 14.

A position where the protrusion 9 is brought into contact with the distal end portion 5*a* is in a state where the covering member 6 is arranged nearest to a side of the contact ring 4 in the axis line direction, and at this position, the inclined surface 6*a* of the covering member 6 and the inclined surface 4*a* of the contact ring 4 become substantially flush with each other, and the gap is substantially closed (see FIGS. 1 and 4). Although a gap exists between the holding tool 5 and the inclined surface 4*a* in this case, the gap on the side of the arc discharge space 22 is blocked by the covering member 6. Therefore, the arc discharge space 22 does not communicate with the gap between the holding tool 5 and the inclined surface 4*a*. Similarly, a position where a side surface of the protrusion 19 is brought into contact with the distal end portion 15*a* is in a state where the covering member 16 is arranged nearest to the side of the contact ring 14 in the axis line direction, and at this position, the inclined surface 16*a* of the covering member 16 and the inclined surface 14*a* of the contact ring 14 become substantially flush with each other, and the gap is substantially closed (see FIG. 1). Therefore, the arc discharge space 22 does not communicate with the gap between the holding tool 15 and the inclined surface 14*a*.

An operation of the present embodiment is explained below. Although an operation of the covering member 6 is mainly explained below with reference to FIGS. 3 to 5, the same explanations are applied to the covering member 16.

An operation in a case where the movable contact 32 moves from a current cutoff position shown in FIG. 4 to a current supply position shown in FIG. 5 is explained first. As shown in FIG. 4, at the current cutoff position, the covering member 6 is arranged nearest to the side of the contact ring 4, and the inclined surface 6*a* of the covering member 6 and the inclined surface 4*a* of the contact ring 4 become flush with each other, which is a state where the gap is closed. When the movable contact 32 is driven by a driving device (not shown) to move from the current cutoff position to the current supply position, because the outer diameter of the movable contact 32 is larger than the inner diameter of the contact ring 4, the movable contact 32 elastically deforms the contact ring 4 outwardly in the radial direction (see FIG. 5). At this time, because the inclined surface 4*a* of the contact ring 4 and the inclined surface 6*a* of the covering member 6 are brought into contact with each other (a portion P in FIG. 5), the covering member 6 is pressed in the axis line direction from the contact ring 4 via the inclined surface 6*a*, and hence the covering member 6 moves to a position where the side surface of the protrusion 9 on the side of the contact ring 14 becomes flush with an opposing surface of the covering member 7 in the axis line direction. That is, when the movable contact 32 is inserted into the contact ring 4, the covering member 6 moves to a state where the covering member 6 is arranged on the side of the contact ring 14 most by being pressed by the contact ring 4 that is elastically deformed by the movable contact 32 (see FIG. 3).

An operation in a case where the movable contact 32 moves from the current supply position shown in FIG. 5 to the current cutoff position shown in FIG. 4 is explained below. When the movable contact 32 is driven by a driving device (not shown) to move from the current supply position to the current cutoff position, when the movable contact 32 is separated from the contact ring 4, the contact ring 4 is recovered to the original state from the state of being elastically deformed, by which the gap 10 is formed between the contact ring 4 and the covering member 6 (see FIG. 3). Furthermore, arc (not shown) is generated between the contact ring 4 and the movable contact 32 by the current cutoff. This arc is first generated between the contact ring 4 and the apical portion 33 of the movable contact 32, and when the movable contact 32 further moves to be separated from the contact ring 14, the arc changes its direction from the apical portion 33 to the contact ring 14. In this manner, the arc is generated in the arc discharge space 22 between the contact rings 4 and 14.

When gas inside the arc discharge space 22 is heated by the arc and becomes high-temperature and high-pressure gas, this gas moves to the outer side in the radial direction by passing through the gap 21 and flows into the heating chamber 23. In this manner, pressure of each of the arc discharge space 22 and the heating chamber 23 is increased by the generation of the arc, and this pressure is applied to the end surface of the covering member 6 on the side of the covering member 16. This pressure is higher than the pressure applied to the inclined surface 6*a* of the covering member 6, moving the covering member 6 to a state shown in FIG. 4 in the axis line direction, and hence the gap 10 between the covering member 6 and the contact ring 4 is eliminated. With this operation, a flow path of the gas flowing out through the gap 10 from the heating chamber 23 or the arc discharge space 22 is blocked, and hence the spray amount of the gas from the heating chamber 23 to the arc is increased and the current cutoff performance can be improved. Although the gap 10 is eliminated by the inclined surface 6*a* of the covering member 6 and the inclined surface 4*a* of the contact ring 4 becoming flush with each other in the present embodiment, the flow path of the gas flowing out through the gap 10 can be blocked by bringing the covering member 6 and the contact ring 4 into contact with each other by a mode other than making the inclined surfaces flush with each other. Alternatively, even when the covering member 6 and the contact ring 4 are not completely brought into contact with each other, when the covering member 6 and the contact ring 4 sufficiently approach to each other so that the width of the gap 10 is sufficiently small, the amount of the gas flowing out through the gap 10 can be suppressed, and hence the current cutoff performance can be improved. The gas pressurized and accumulated in the heating chamber 23 flows to the arc discharge space 22 via the gap 21, and by the gas being sprayed to the arc, the arc is extinguished.

As explained above, in the present embodiment, the covering members 6 and 16 are configured to be slidable within a predetermined range in the axis line direction, and hence the covering members 6 and 16 move to positions where the covering members 6 and 16 are brought into contact with the contact rings 4 and 14, respectively, by the pressure of the high-temperature gas heated by the arc at the time of current cutoff, so that the gap between the covering member 6 and the contact ring 4 and the gap between the covering member 16 and the contact ring 14 can be eliminated. This can prevent the gas having passed through the gap from flowing out, and hence the high-temperature gas generated in the arc discharge space 22 can be effectively introduced to the heating chamber 23, and at the same time, the flow of the gas from the heating chamber 23 to the arc discharge space 22 at the time of extinguishing the arc can be increased, enabling the arc-extinguishing gas to be effectively sprayed to the arc. Furthermore, at the time of supplying a current, the covering members 6 and 16 can be restored to the original positions by the elastic deformation of the contact rings 4 and 14. With this configuration, the covering members 6 and 16 do not interrupt a current supply operation.

The covering members 6 and 16 secure the speed of spraying the gas by forming the gap 21, and is worn by the high-temperature gas by generation of the arc, and hence the gas pressure in the arc discharge space 22 is further increased due to wear and evaporation of a portion of the covering members 6 and 16, which contributes to the improvement of the current cutoff performance.

In the present embodiment, the protrusions 9 and 19 are provided on the covering members 6 and 16, respectively, the covering member 6 is attached to the holding tool 5 in a movable manner in the axis line direction by arranging the protrusion 9 in the recessed portion 70 that is formed by the distal end portion 5*a* of the holding tool 5 and the covering member 7, and the covering member 16 is attached to the holding tool 15 in a movable manner in the axis line direction by arranging the protrusion 19 in the recessed portion 71 that is formed by the distal end portion 15*a* of the holding tool 15 and the covering member 17. However, any attachment method can be used as long as the covering members 6 and 16 can be attached to the holding tools 5 and 15, respectively, in a movable manner in the axis line direction, which is not limited to the configuration example of the present embodiment. For example, recessed portions can be respectively provided on the covering members 6 and 16 and protrusions can be respectively provided on the covering members 7 and 17.

Second Embodiment

In the first embodiment, the covering member attached to the distal end portion 5*a* of the holding tool 5 is configured with two covering members 6 and 7, and the covering member attached to the distal end portion 15*a* of the holding tool 15 is configured with two covering members 16 and 17. However, in a second embodiment of the present invention, the covering member attached to the distal end portion 5*a* of the holding tool 5 is integrally formed in a slidable manner in the axis line direction, and the covering member attached to the distal end portion 15*a* of the holding tool 15 is integrally formed in a slidable manner in the axis line direction.

Figure 6:
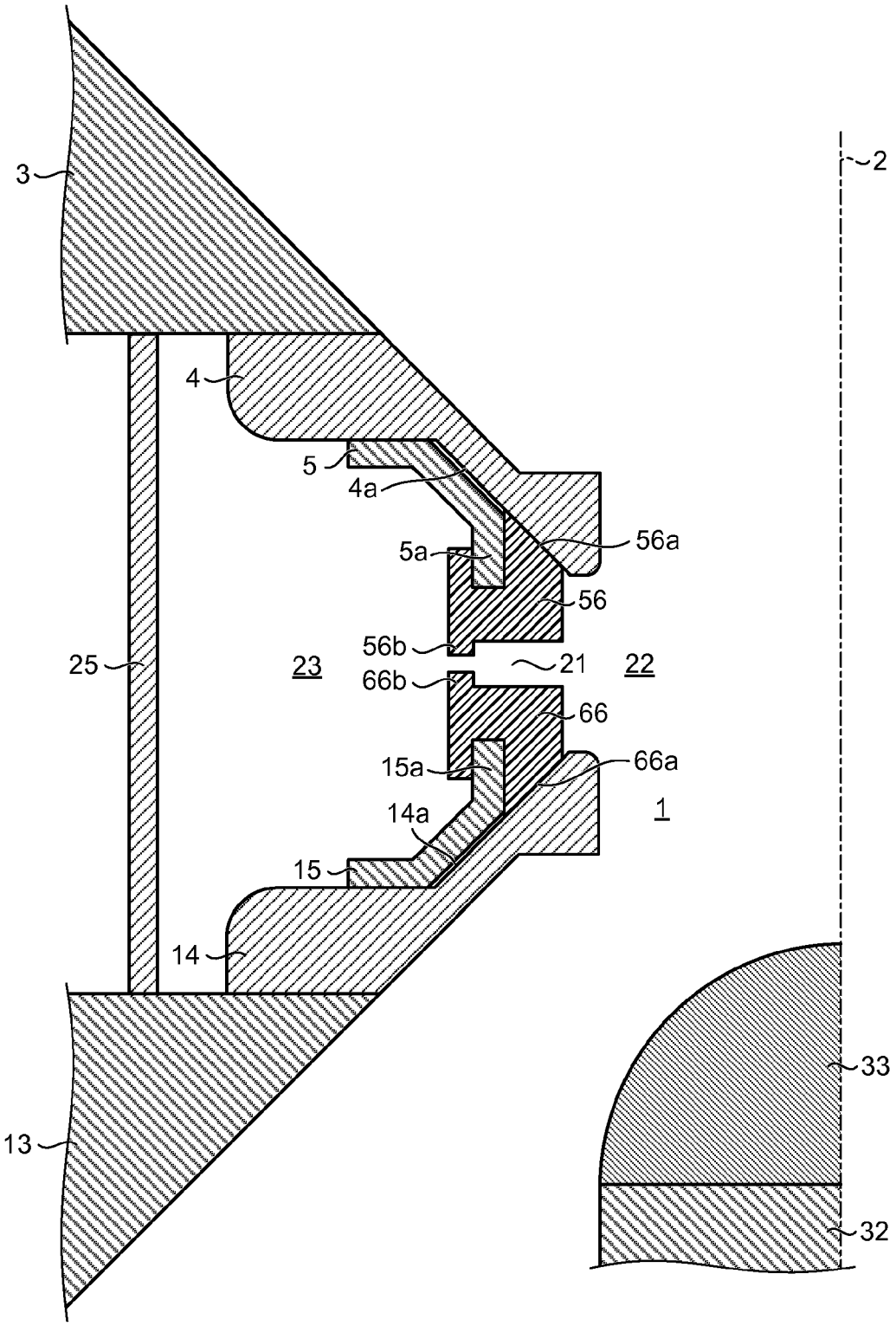
FIG. 6 is a cross-sectional view of a configuration of an arc-extinguishing chamber of a gas circuit breaker according to a second embodiment, depicting an arrangement configuration at the time of cutting off a current.
Figure 7:
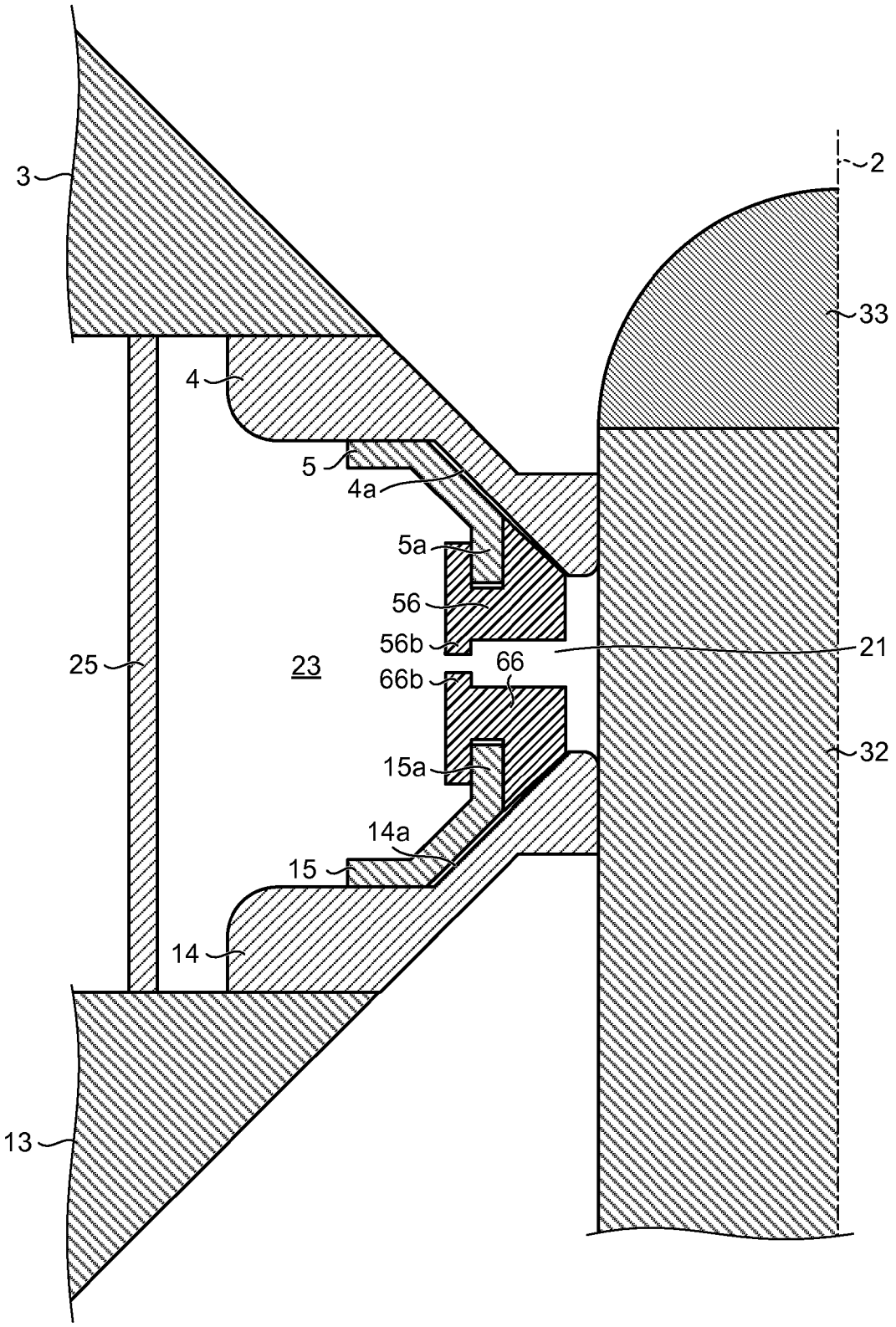
FIG. 7 is cross-sectional view of the configuration of the arc-extinguishing chamber of the gas circuit breaker according to the second embodiment, depicting an arrangement configuration at the time of supplying a current.
Figure 8:
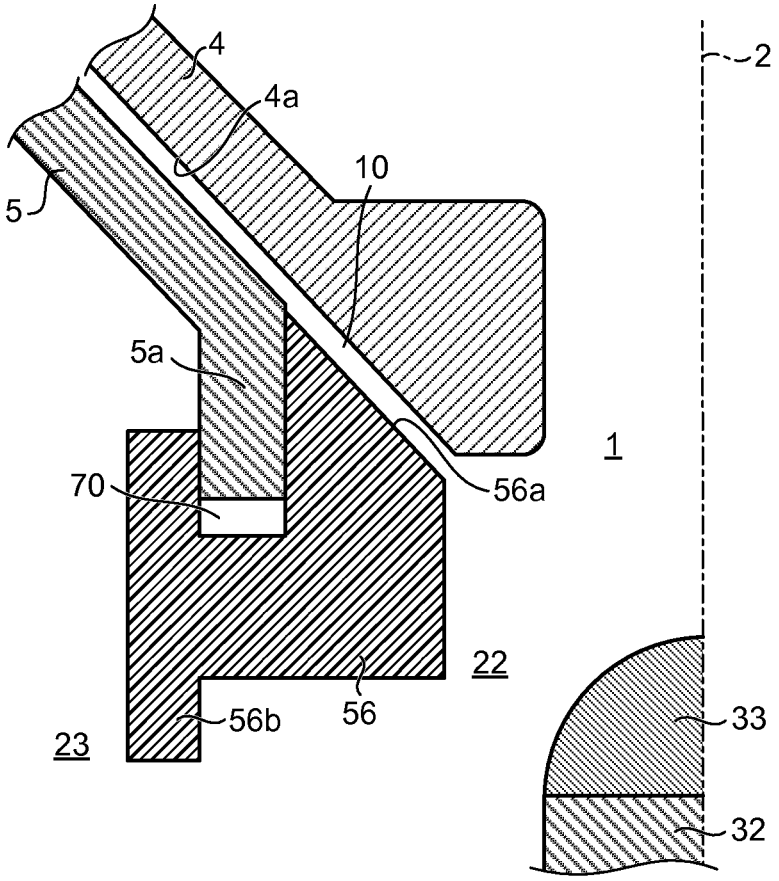
FIG. 8 is a cross-sectional view of a portion of relevant parts of an arc-extinguishing chamber in the middle of current cutoff according to the second embodiment.
Figure 9:
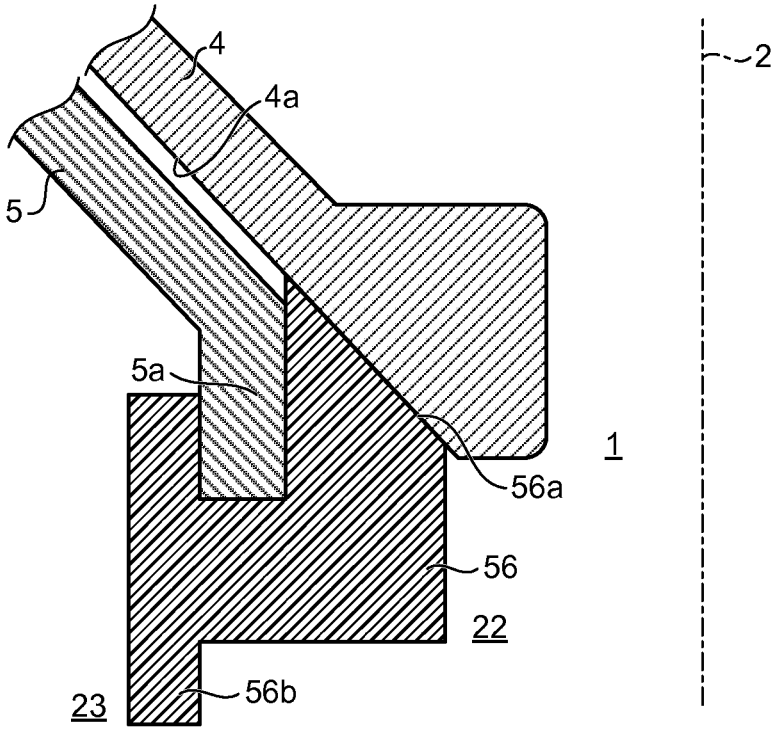
FIG. 9 is a diagram corresponding to FIG. 8 in a current cutoff state.
Figure 10:
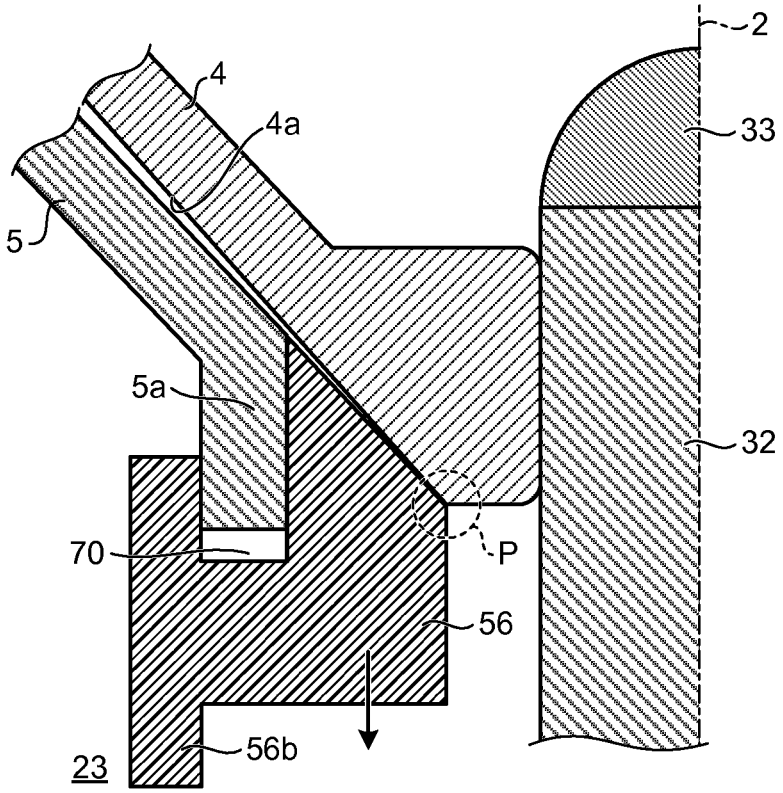
FIG. 10 is a diagram corresponding to FIG. 8 in a current supply state.

FIG. 6 is a cross-sectional view of a configuration of an arc-extinguishing chamber of a gas circuit breaker according to the present embodiment, depicting an arrangement configuration at the time of cutting off a current. FIG. 7 is a cross-sectional view of the configuration of the arc-extinguishing chamber of the gas circuit breaker according to the present embodiment, depicting an arrangement configuration at the time of supplying a current. FIG. 8 is a cross-sectional view of a portion of relevant parts of an arc-extinguishing chamber in the middle of current cutoff. FIG. 9 is a diagram corresponding to FIG. 8 in a current cutoff state, and FIG. 10 is a diagram corresponding to FIG. 8 in a current supply state. In FIGS. 6 to 10, like constituent elements as those in FIGS. 1 to 5 are denoted by like reference signs and detailed explanations thereof will be omitted.

A covering member 56 (first covering member) is attached to the distal end portion 5*a* of the holding tool 5. The covering member 56 is formed in an annular shape. The covering member 56 includes an inclined surface 56*a* which is parallel to the inclined surface 4*a* on the side of the contact ring 4. Differently from the first embodiment, no screw portion is formed on the distal end portion 5*a* of the holding tool 5, and the distal end portion 5*a* is slidably fitted into an engagement groove provided on the covering member 56 in the axis line direction. Further, a protrusion 56*b* that extends in the axis line direction toward the side of the contact ring 14 is provided on the covering member 56. The protrusion 56*b* is provided only on a portion in a circumferential direction around the central axis line 2.

A covering member 66 (second covering member) is attached to the distal end portion 15*a* of the holding tool 15. The covering member 66 is formed in an annular shape. The covering member 66 includes an inclined surface 66*a* which is parallel to the inclined surface 14*a* on the side of the contact ring 14. Differently from the first embodiment, no screw portion is formed on the distal end portion 15*a* of the holding tool 15, and the distal end portion 15*a* is slidably fitted into an engagement groove provided on the covering member 66 in the axis line direction. Further, a protrusion 66*b* that extends in the axis line direction toward the side of the contact ring 4 is provided on the covering member 66. The protrusion 66*b* is provided only on a portion in the circumferential direction around the central axis line 2. The protrusion 66*b* is arranged at a position facing the protrusion 56*b* in the circumferential direction.

The reason why the protrusions 56*b* and 66*b* are provided is as follows. Because the covering member 56 is fitted in the distal end portion 5*a* in a slidable manner to be movable in the axis line direction, there is a risk that the covering member 56 drops off toward the side of the contact ring 14 in this state. Similarly, because the covering member 66 is fitted in the distal end portion 15*a* in a slidable manner to be movable in the axis line direction, there is a risk that the covering member 66 drops off toward the side of the contact ring 4 in this state. Therefore, the protrusions 56*b* and 66*b* are provided at positions corresponding to end surfaces of the covering members 56 and 66 facing each other, so that the movement of the covering members 56 and 66 in a direction in which the covering members 56 and 66 approach to each other can be locked. However, in order to cause the gap 21 and the heating chamber 23 to communicate with each other, the protrusions 56*b* and 66*b* are provided only on a portion in the circumferential direction, so that the flow path of the gas can be secured between the heating chamber 23 and the arc discharge space 22.

Operations of the present embodiment are identical to those of the first embodiment. In addition, the present embodiment has effects identical to those of the first embodiment.

INDUSTRIAL APPLICABILITY

As described above, the present invention is useful as a gas circuit breaker.

REFERENCE SIGNS LIST

1 Contact area
2 Central axis line
3, 13 Holding member
4*a*, 14*a* Inclined surface
4, 14 Contact ring
5*a*, 15*a* Distal end portion
5, 15 Holding tool
6*a*, 16*a*, 56*a*, 66*a* Inclined surface
6, 7, 16, 17, 56, 66 Covering member
8, 18 Screw portion
9, 19, 56*b*, 66*b* Protrusion

10, 21 Gap
22 Arc discharge space
23 Heating chamber
25 Partition
32 Movable contact
33 Apical portion
70, 71 Recessed portion

The invention claimed is:

1. A gas circuit breaker comprising:

a first fixed contact and a second fixed contact arranged facing each other at a predetermined interval in an axis line direction, each of the first and second fixed contacts being formed of an elastically deformable material in an annular shape around an axis line;

a movable contact inserted into the first and second fixed contacts and reciprocally movable along the axis line direction between a current supply position where the movable contact bridges the first fixed contact and the second fixed contact and a current cutoff position where the movable contact is separated from both the first and second fixed contacts;

a first holding tool formed in an annular shape and attached to a surface of the first fixed contact on a side of the second fixed contact;

a second holding tool formed in an annular shape and attached to a surface of the second fixed contact on a side of the first fixed contact;

a first covering member having electrically insulating property, slidably attached to a distal end portion of the first holding tool and covering at least an inner diameter side of the distal end portion, the first covering member being slidable in the axis line direction so as to be brought into contact with the first fixed contact in a state of being arranged nearest to the side of the first fixed contact; and a second covering member having electrically insulating property, slidably attached to a distal end portion of the second holding tool and covering at least an inner diameter side of the distal end portion, the second covering member being slidable in the axis line direction so as to be brought into contact with the second fixed contact in a state of being arranged nearest to the side of the second fixed contact.

2. The gas circuit breaker according to claim 1, wherein in a state where the first covering member is arranged nearest to the side of the first fixed contact, a surface of the first fixed contact becomes flush with a surface of the first covering member facing the first fixed contact, and in a state where the second covering member is arranged nearest to the side of the second fixed contact, a surface of the second fixed contact becomes flush with a surface of the second covering member facing the second fixed contact.

3. The gas circuit breaker according to claim 2, comprising:

a third covering member having electrically insulating property, fixed to the distal end portion of the first holding tool, and configured to cover at least an outer diameter side of the distal end portion and to limit a sliding range of the first covering member upon slidably attaching the first covering member to the distal end portion in the axis line direction; and a fourth covering member having electrically insulating property, fixed to the distal end portion of the second holding tool, and configured to cover at least an outer diameter side of the distal end portion and to limit a sliding range of the second covering member upon slidably attaching the second covering member to the distal end portion in the axis line direction.

4. The gas circuit breaker according to claim 3, comprising:

an arc discharge space formed between the first fixed contact and the second fixed contact; and a heating chamber surrounded by a partition surrounding an arc-extinguishing chamber including the arc discharge space, the first and second holding members, and the third and fourth covering members, wherein the arc discharge space and the heating chamber communicate with each other through a gap between the first and second fixed contacts.

5. The gas circuit breaker according to claim 4, wherein the first and second covering members are configured to move to a position where the first and second covering members are brought into contact with the first and second fixed contacts, respectively, by a pressure of arc-extinguishing gas heated by an arc generated in the arc discharge space at a time of cutting off a current.

6. The gas circuit breaker according to claim 5, wherein an outer diameter of the movable contact is larger than an inner diameter of each of the first and second fixed contacts, and the movable contact is configured to move the first covering member nearest to the side of the second fixed contact and move the second covering member nearest to the side of the first fixed contact by elastically deforming the first and second fixed contacts outwardly in a radial direction at a time of supplying a current.

7. The gas circuit breaker according to claim 3, wherein the first covering member includes a first protrusion on an outer diameter surface, the first protrusion is arranged in a first recessed portion defined by the third covering member and the first holding tool, a length of the first recessed portion in the axis line direction is longer than a length of the first protrusion in the axis line direction, the second covering member includes a second protrusion on an outer diameter surface, the second protrusion is arranged in a second recessed portion defined by the fourth covering member and the second holding tool, and a length of the second recessed portion in the axis line direction is longer than a length of the second protrusion in the axis line direction.

8. The gas circuit breaker according to claim 1, further comprising an arc discharge space formed between the first fixed contact and the second fixed contact, wherein the first and second covering members are configured to be brought into contact with the first and second fixed contacts, respectively, by a pressure of arc-extinguishing gas heated by an arc generated in the arc discharge space at a time of cutting off a current.

* * * * *